US010155307B2

(12) United States Patent
Tian

(10) Patent No.: US 10,155,307 B2
(45) Date of Patent: Dec. 18, 2018

(54) PIPE WRENCH

(71) Applicant: SHANGHAI KUNJEK HANDTOOLS AND HARDWARE CO., LTD., Shanghai (CN)

(72) Inventor: Yeqing Tian, Shanghai (CN)

(73) Assignee: SHANGHAI KUNJEK HANDTOOLS AND HARDWARE CO., LTD., Shanghai (CN)

( * ) Notice: Subject to any disclaimer, the term of this patent is extended or adjusted under 35 U.S.C. 154(b) by 124 days.

(21) Appl. No.: 15/032,589

(22) PCT Filed: Sep. 22, 2014

(86) PCT No.: PCT/CN2014/087026

§ 371 (c)(1),
(2) Date: Apr. 27, 2016

(87) PCT Pub. No.: WO2015/062375

PCT Pub. Date: May 7, 2015

(65) Prior Publication Data

US 2016/0288312 A1 Oct. 6, 2016

(30) Foreign Application Priority Data

Oct. 30, 2013 (CN) ..... 2013 2 0681507 U

(51) Int. Cl.
*B25G 1/04* (2006.01)
*B25B 13/50* (2006.01)

(52) U.S. Cl.
CPC ..... *B25G 1/043* (2013.01); *B25B 13/505* (2013.01)

(58) Field of Classification Search
CPC ..... B25G 1/043; B25B 13/505
USPC ..... 81/177.2
See application file for complete search history.

(56) References Cited

U.S. PATENT DOCUMENTS 614,255 A * 11/1898 McChesney ..... B25B 13/28 81/177.2
1,407,237 A * 2/1922 Thompson ..... A01B 1/022 294/57
1,753,441 A * 4/1930 Morehouse ..... B25G 1/00 279/76
4,070,932 A * 1/1978 Jeannotte ..... B25G 1/043 16/429
5,361,655 A 11/1994 Fowlkes
(Continued)

FOREIGN PATENT DOCUMENTS

CN 203579497 U 5/2014
GB 2370802 A 7/2002

OTHER PUBLICATIONS

International Search Report and Written Opinion dated Dec. 19, 2014 for Application No. PCT/CN2014/087026.

*Primary Examiner* — Hadi Shakeri
(74) *Attorney, Agent, or Firm* — Patterson & Sheridan LLP

(57) ABSTRACT

A pipe wrench includes jaws and a handle portion. The handle portion includes an outer shell disposed outside and an extension body encircled by the outer shell. A first end of the extension body extends into interior of the outer shell. A second end of the extension body is connected to the jaws. The outer shell and the extension body are not rotatable relative to each other. The handle portion further includes a locking element encircling the second end of the extension body.

15 Claims, 3 Drawing Sheets

(56) References Cited

U.S. PATENT DOCUMENTS

| | | | | |
|---|---|---|---|---|
| 6,155,144 | A * | 12/2000 | Lin | B25B 15/02 81/177.2 |
| 6,327,941 | B1 | 12/2001 | Cheng | |
| 6,938,525 | B2 * | 9/2005 | Poole | B25B 5/068 81/151 |
| 7,121,172 | B1 * | 10/2006 | Daniels | B25B 13/28 81/177.2 |
| 8,533,890 | B2 * | 9/2013 | Pannell | A47L 13/022 15/111 |
| 2010/0236364 | A1 | 9/2010 | Leighton | |
| 2013/0234458 | A1 | 9/2013 | Wilkins | |

* cited by examiner

PIPE WRENCH

TECHNICAL FIELD

The present disclosure relates to hand tools. More particularly, the present disclosure relates to pipe wrenches.

BACKGROUND

Pipe wrenches are designed to install fasteners on elongated components, such as pipes or electric cables. For example, pipe wrenches may be used to install forged screws on pipes for fuels or liquefied gas, to secure pipes on to metrology devices on fuel injection systems, or to fasten hydraulic valves or hydraulic breaks onto hydraulic devices.

However, existing pipe wrenches typically have a fixed length handle which is inconvenient.

SUMMARY

The present disclosure provides a wrench pipe having a handle portion that is adjustable within a predetermined range to solve the problem of inconvenience to use caused by a handle with a fixed length.

The technical solution of the present disclosure is as follows:

One embodiment provides a pipe wrench including jaws and a handle portion. The handle portion includes an outer shell disposed at the exterior and an extension body encircled by the outer shell. A first end of the extension body extends into interior of the outer shell. A second end of the extension body is connected to the jaws. The outer shell and the extension body are not rotatable relative to each other. The handle portion further includes a locking element encircling the second end of the extension body. The locking element is connected to the outer shell. The extension body is not rotatable relative to the locking element.

The extension body is extendable out of the outer shell but not retractable back to the outer shell when the locking element is in a locked position.

The extension body is extendable out of the outer shell and retractable back to the outer shell when the locking element is in a unlock position.

In another embodiment, the locking element is a locking plate having a loop portion configured to encircle the extension body and a plate portion configured to fixedly attach to the outer shell.

The locking plate is in the locked position when the loop portion of the locking plate is tilted relative to the extension body.

The locking plate is in the unlock position when the loop portion of the locking plate is perpendicular or substantially perpendicular to the extension body. The locking element may have a shape other than a plate.

In another embodiment, the pipe wrench further includes a push button disposed on the outer shell. The push button is configured to unlock the locking plate. The push button is coupled to an outer side surface of the outer shell through a first spring element. A first end of the push button is connected to the plate portion of the locking plate. A second end of the push button is pushable. The plate portion of the locking plate is moved to be perpendicular to or substantially perpendicular to the extension body by pushing the second end of the push button. The locking element may be released by other suitable mechanism.

In another embodiment, the pipe wrench further includes a second spring element disposed between the outer shell and the extension body. The extension body has a retaining hole for retaining the second spring element. A first end of the second spring element is secured to the outer shell at an end distal from the jaws. A second end of the second spring element is connected to a bottom of the retaining hole. In one embodiment, the second spring element is a tension spring. The configuration of the tension spring enables the extension body to automatically retract back into the outer shell when the locking member is at the unlock position, thus, making the pipe wrench convenient to use.

In one embodiment, the outer shell and the extension body are columns having squared cross sections. The structure of square shaped columns ensures that the extension body and the outer shell do not rotate relative to each other. The square shaped columns are easy to manufacture. Pipe wrenches having square shaped handles are proven to lock and release smoothly in use.

In one embodiment, the outer shell includes a protruding portion extending from one side. The protruding portion has a through hole. The plate portion of the locking plate is threaded through the through hole to connect with the first end of the push button in a fixed manner.

In one embodiment, the first end of the push button has a slot. The plate portion of the locking plate is inserted into the slot and secured to the slot to prevent the locking plate from falling out of the slot. In one embodiment, the secure connection is made by interference fit or a structure with a ratchet tooth.

In another embodiment, the pipe wrench further includes an energy saving handle disposed through the outer shell at a distal end from the jaws. A first end of the tension spring is attached to the energy saving handle. A pin is disposed at the bottom of the retaining hole in the extension body. A second end of the tension spring encircles the pin. The energy saving handle makes it easier for a user to use the pipe wrench. Additionally, the energy saving handle also provides a structure to secure the first end of the tension spring. The above configuration of connecting the first and second ends of the tension spring is only one example. Embodiments of the present disclosure include other methods for securing the first and second ends of the tension spring.

In another embodiment, the pipe wrench further includes a stopper element disposed near the second end of the extension body. The stopper element is disposed in an inner side of the locking element to limit movement of the extension body to prevent the extension body from falling off the outer shell.

Compared to the existing pipe wrench, pipe wrenches of the present disclosure have the following advantages:

The wrench pipe according to the present disclosure has an adjustable handle portion. Particularly, length of the handle portion is adjustable within a predetermined range, making the pipe wrench convenience to use.

BRIEF DESCRIPTION OF THE DRAWINGS

So that the manner in which the above recited features of the present disclosure can be understood in detail, a more particular description of the various aspects, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
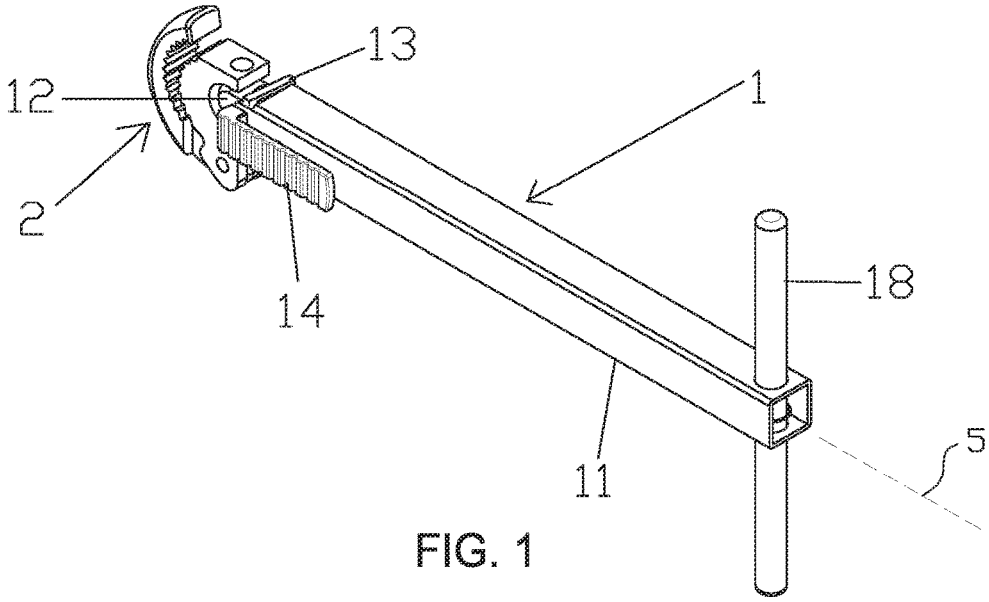
FIG. 1 is a perspective view of a pipe wrench according to the present disclosure.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The present disclosure provides a pipe wrench having a handle portion with its length adjustable within a predetermined range. The pipe wrench of the present disclosure is described in detail below in association with the drawings.

EXAMPLE

Figure 2:
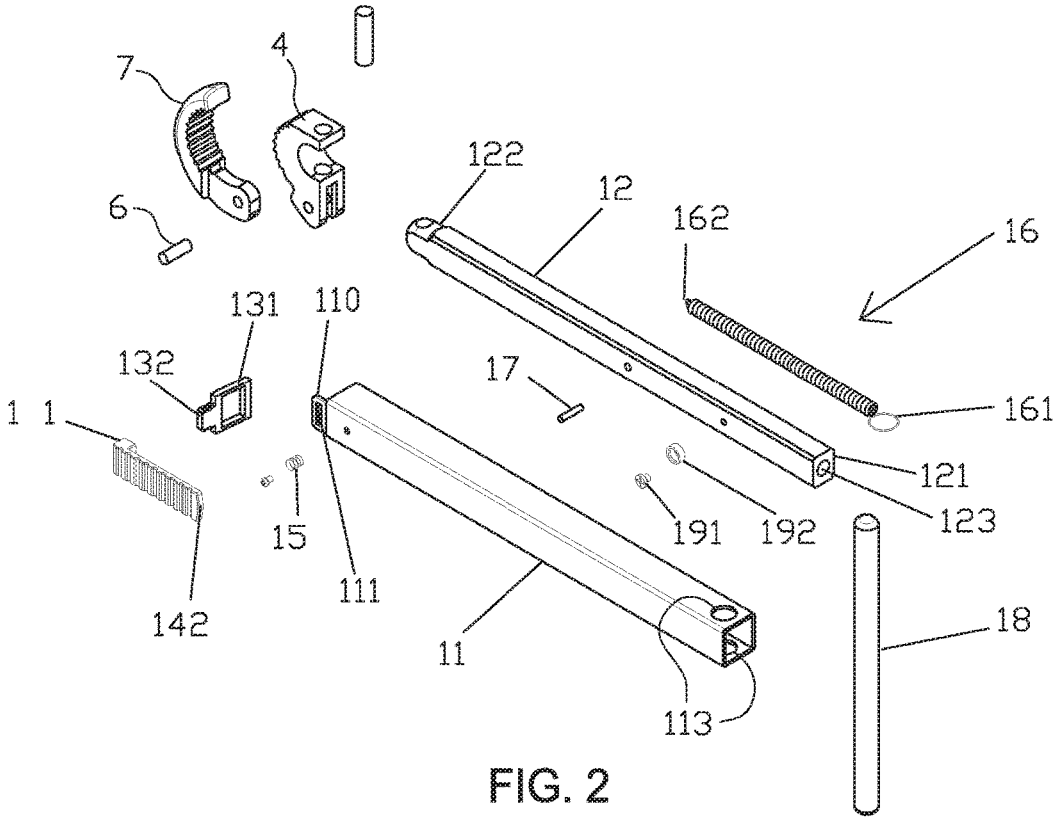
FIG. 2 is an exploded view of the pipe wrench according to the present disclosure.

FIG. 1 and FIG. 2 illustrate a pipe wrench according to one embodiment. The pipe wrench includes a handle portion 1 and jaws 2. The jaws 2 may include an inner jaw 4 and an outer jaw 7 joined together by a joint 6. During operation, a work piece is held between the inner jaw 4 and the outer jaw 7. The relative position of the inner jaw 4 and outer jaw 7 may be adjusted by well known technology. The present disclosure only illustrates one configuration of the jaws 2. It should be noted that any suitable configuration of jaws for a pipe wrench may be used with the handle portion 1 according to embodiments of the present disclosure.

The handle portion 1 includes an outer shell 11 that forms the exterior and an extension body 12 encircled by the outer shell 11. A first end 121 of the extension body 12 extends into the interior of the outer shell 11. A second end 122 of the extension body 12 is coupled to the jaws 2. As shown in FIG. 2, the second end 122 of the extension body 12 may be fixedly coupled to the inner jaw 5. The extension body 12 may slide along a longitudinal axis 5 of the outer shell 11. The outer shell 11 and the extension body 12 cannot rotate relative to each other so that a force applied to the outer shell 11 by a user may be transferred to the jaws 2 through the extension body 12. The outer shell 11 and the extension body 12 may have any non-circular cross sections to prevent relative rotations. The interior volume of the outer shell 11 may be shaped to receive the extension body 12 therein permitting relative movement along the longitudinal axis 5 but prohibiting relative rotation about the longitudinal axis 5. Alternatively, rotation preventing structures may be formed in the outer shell 11 and the extension body 12 to prevent rotation. In one embodiment, the outer shell 11 and the extension body 12 are columns with squared cross section to prevent rotation relative to each other. In another embodiment, a groove and a matching protrusion may be formed between the outer shell 11 and the extension body 12 to prevent relative rotation.

The handle portion 1 also includes a locking element 13 encircling side surfaces outside the second end 122 of the extension body 12. The locking element 13 is also connected to the outer shell 11. The extension body 12 cannot rotate relative to the locking element 13. In one embodiment, the locking element 13 is a locking plate having a loop portion 131 configured to encircle the extension body 12 and a plate portion 132 configured to secure to the outer shell 11. The loop portion 131 and the plate portion 132 may be formed in a unitary body. When the locking element 13 is tilted relative to the extension body 12, the locking element 13 is in a locked position. At the locked position, the extension body 12 may extend out of the outer shell 11 to adjust the length of the handle portion 1 while the extension body 12 cannot retract back to the outer shell 11. When the locking element 13 is perpendicular or substantially perpendicular to the extension body 12, the locking element 13 is in an unlock position. At the unlock position, the extension body 12 can extend out of or retract back into the outer shell 11. Since the extension body 12 can also extend out of the outer shell 11 at the locked position, the unlock position is mainly used to allow the extension 12 retract back to the outer shell 11. It should be noted that the locking element 13 may have other suitable shape.

Figure 3:
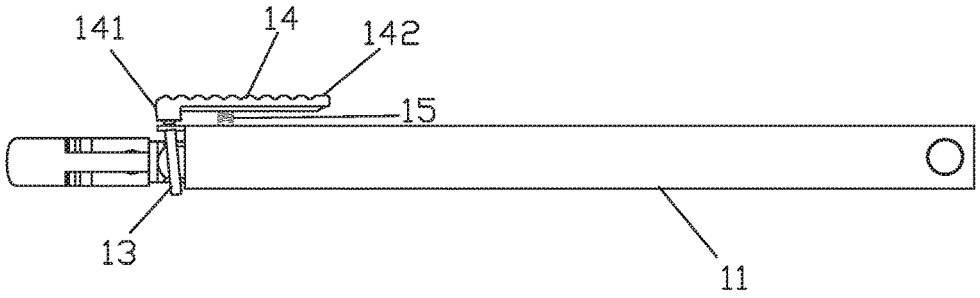
FIGS. 3 and 4 schematically illustrate the pipe wrench in a normal position.
Figure 4:
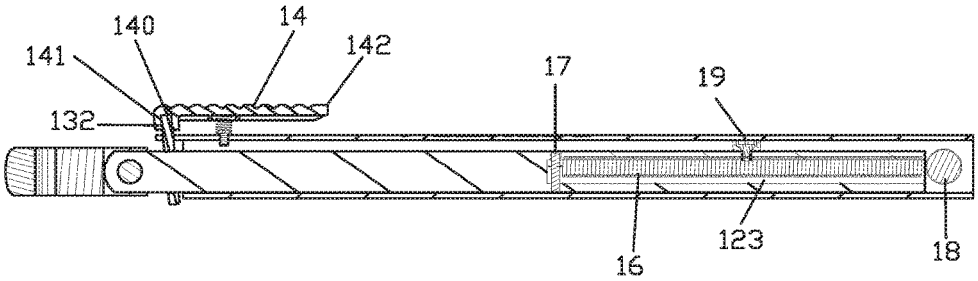

In one embodiment, as shown in FIG. 3 and FIG. 4, the locking element 13 may be unlocked by operating a push button 14 disposed on the outer shell 11. A central portion of the push button 14 is coupled to a side surface of the outer shell 11 through a first spring element 15. A first end 141 of the bush button 14 is connected to the plate portion 132 of the locking element 13. A second end 142 of the push button 14 is be pressed down. Pressing the second end 142 moves the plate portion 132 of the locking element 13 resulting in the locking element 13 to be perpendicular to or substantially perpendicular to the extension body 12. In one embodiment, the first spring element 15 is a compression spring. However, embodiments of the present disclosure are not limited to the unlocking/locking mechanism described above. Anything suitable locking/unlocking mechanism may be used.

In one embodiment, the push button 14, the outer shell 11 and the locking element 13 may be connected as follows: a protruding portion 110 may extend from one side of the outer shell 11; the protruding portion 110 includes a through hole 111, the plate portion 132 of the locking element 13 threads through the through hole 111 to connect with the first end 141 of the push button 14. The push button 14 and the locking element 13 may be connected as follows: the first end 141 of the push button 14 has a slot 140 (recess opening); the plate portion 132 of the locking element 13 is inserted into the slot 140; the plate portion 132 may be fixedly secured in the slot 140 to prevent the locking element 13 from falling out of the slot 140, as shown in FIG. 4. In one embodiment, the plate portion 132 is secured to the slot 140 by interference fit. Alternatively, other mechanisms for a secure joint, such as ratchet pawl, may be used. However, the connection of the push button 14, the outer shell 11 and the locking element 13 is not limited to the mechanism described above. The scope of the present disclosure encompasses any modifications that may be made by persons skilled in the art according to the present disclosure to achieve the same functions.

Figure 6:
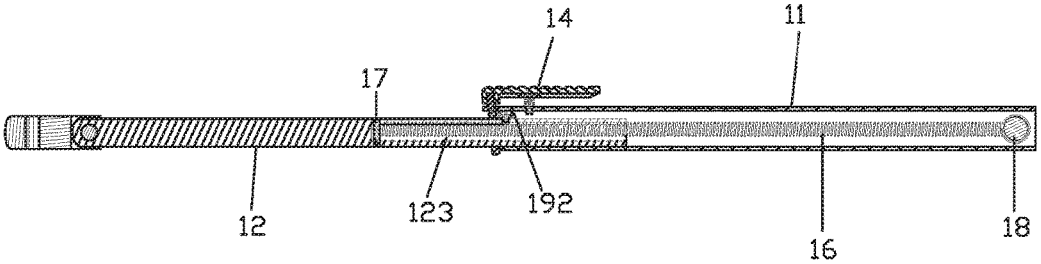

In one embodiment, a second spring element 16 may be disposed between the outer shell 11 and the extension body 12. The second spring element 16 may be used to allow the extension body 12 to automatically retract back into the outer shell 11 when the locking element 13 is in the unlocked position. In one embodiment, the second spring element 16 may be a tension spring. The extension body 12 may have a retaining hole 123 formed therein, as shown FIGS. 2, 4 and 6. A first end 161 of the second spring element 16 is secured to the end of the outer shell 11 that is opposite to the end connected to the jaws 2. A second end 162 of the second spring element 16 is connected to the extension body 12 at a bottom of the retaining hole 123. In one embodiment, a pin 17 may be disposed near the bottom of the retaining hole 123. The pin 17 may be positioned cross the retaining hole 123. The second end 162 of the second spring element 16 encircles the pin 17. An energy saving handle 18 may be positioned (through openings 113) on the end of the outer shell 11 that is opposite to the jaws 2. The first end 161 of the spring element 16 may encircle the energy saving handle 18 as shown in FIGS. 4 and 6. Alternatively, the second spring element 16 may be secured to the end of the outer shell 11 that is opposite to the jaws 2 by other mechanisms. Embodiments of the present disclosure are not limited to the example described above. The advantages of using the spring element 16, such as a tension spring, is to enable the extension body 12 to automatically retract back into the outer shell 11 when the locking element 13 is at the unlock position, therefore, making the pipe wrench convenient to use.

In one embodiment, a stopper element 19 may be disposed near the second end (first end 121) of the extension body 12, as shown in FIG. 4. The stopper element 19 is disposed at an inner side of the locking element 13 to limit the movement of the extension body 12 so that the extension body 12 does not extend completely out of the outer shell 11. In one embodiment, the stopper element 19 includes a bolt 191 and a nut 192 matching the bolt 191, as shown in FIG. 2. When the extension body 12 is pulled to out from the outer shell 11 to a position that the nut 192 attaches the locking element 13, the nut 192 stops the extension body 12 from extending any farther and the extension body 12 reaches its farthest position and the handle portion 1 of the pipe wrench reaches its maximal length, as shown in FIG. 6.

Figure 5:
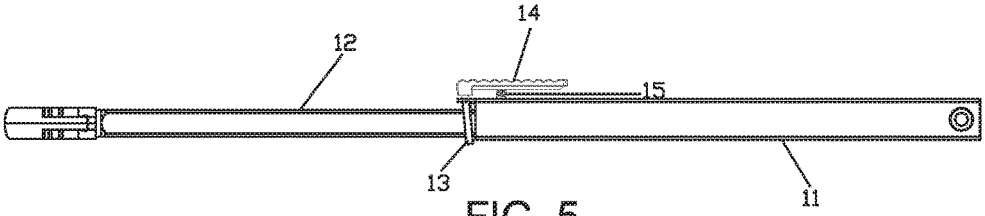
FIGS. 5 and 6 schematically illustrate the pipe wrench with its handle portion at the longest length.
Figure 7:
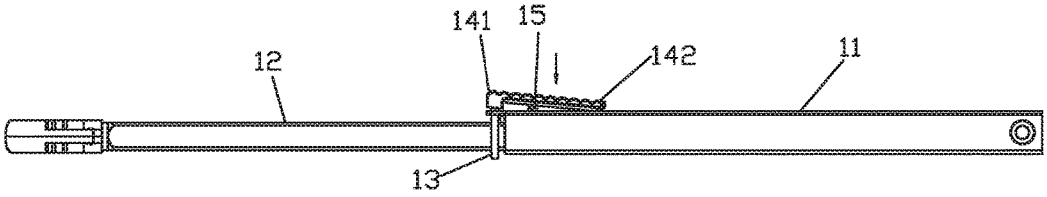
FIGS. 7 and 8 schematically illustrate the pipe wrench in a unlock position.
Figure 8:
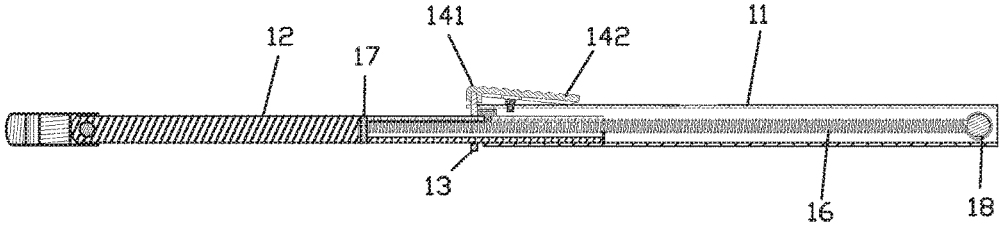

When the pipe wrench is at a normal position, as shown in FIG. 3, the locking element 13 is at the lock position where the locking element 13 is tilted relative to the extension body 12. FIG. 4 schematically illustrates a sectional view of the normal position. If there is a need to lengthen the handle pull the extension body 12 towards the left so that the extension body 12 gradually extends out of the outer shell 11. When the nut 192 of the stopper element 19 touches an inner side of the locking element 13, the extension body 12 is pulled to the limit and the handle of the pipe wrench reaches the maximal length as shown in FIG. 5. FIG. 6 is a schematic sectional view of the pipe wrench at its maximal handle length. After finish using the pipe wrench, press the second end 142 of the push button 14 causing the spring 15 to compress. As the second end 142 of the push button 14 moves downward, the existence of the compression spring 15 causing the first end 141 of the push button 14 to move backwards, thus moving the plate portion 132 of the locking element 13 backward along with the loop portion 131. As a result, the entire locking element 13 pivots to be perpendicular or substantially perpendicular to the extension body 12, as shown in FIGS. 7 and 8. At this position, the locking element 13 releases its lock on the extension body 12, the extension body 12 retracts automatically back to the outer shell 11 under the tension of the second spring element 16 and back to the normal position shown in FIGS. 3 and 4.

The wrench pipe according to the present disclosure has an adjustable handle portion. Particularly, length of the handle portion is adjustable within a predetermined range and may be maintained in any position within the predetermined range, making the pipe wrench convenience to use.

While the foregoing is directed to embodiments of the present disclosure, other and further embodiments may be devised without departing from the basic scope thereof, and the scope thereof is determined by the claims that follow.

The invention claimed is:

1. A pipe wrench comprising:

jaws; and a handle portion, wherein the handle portion comprising:

an outer shell disposed outside;

an extension body encircled by the outer shell, wherein a first end of the extension body extends into interior of the outer shell, a second end of the extension body is connected to the jaws, and the outer shell and the extension body are not rotatable relative to each other;

a locking element encircling the extension body, wherein the locking element is also connected to the outer shell, and the extension body is not rotatable relative to the locking element;

a spring element disposed between the outer shell and the extension body, wherein the extension body has a retaining hole for retaining the spring element, a first end of the spring element extends out of the extension body and is secured to the outer shell at an end distal from the jaws; and a push button disposed on the outer shell, wherein the extension body is extendable out of the outer shell but not retractable back to the outer shell when the locking element is in a locked position, and the extension body is extendable out of the outer shell and retractable back to the outer shell when the locking element is in an unlock position, wherein the locking element is a locking plate having a loop portion configured to encircle the extension body and a plate portion configured to fixedly attach to the outer shell, wherein the locking plate is in the locked position when the loop portion of the locking plate is tilted relative to the extension body, and the locking plate is in the unlock position when the loop portion of the locking plate is perpendicular or substantially perpendicular to the extension body, wherein the push button is configured to unlock the locking plate, the push button is coupled to an outer side surface of the outer shell through a push button spring element, a first end of the push button is connected to the plate portion of the locking plate, a second end of the push button is pushable, the plate portion of the locking plate is moved to be perpendicular to or substantially perpendicular to the extension body by pushing the second end of the push button, wherein the outer shell comprises a protruding portion extending from one side, the protruding portion has a through hole, and the plate portion of the locking plate is threaded through the through hole to connect with the first end of the push button.

2. The pipe wrench of claim 1, wherein a second end of the second spring element is connected to a bottom of the retaining hole.

3. The pipe wrench of claim 2, wherein the outer shell and the extension body are columns having squared cross sections.

4. The pipe wrench of claim 2, wherein the second spring element is a tension spring.

5. The pipe wrench of claim 4, further comprising an energy saving handle disposed through the outer shell at a distal end from the jaws, wherein a first end of the tension spring is attached to the energy saving handle, a bolt or a pin is disposed at the bottom of the retaining hole in the extension body, and a second end of the tension spring encircles the bolt or the pin.

6. The pipe wrench of claim 1, wherein the first end of the push button has a slot, the plate portion of the locking plate is inserted into the slot and secured to the slot to prevent the locking plate from falling out of the slot.

7. The pipe wrench of claim 1, further comprising a stopper element disposed near the second end of the extension body, wherein the stopper element is disposed in an inner side of the locking element to limit movement of the extension body to prevent the extension body from falling off the outer shell.

8. A pipe wrench comprising:

jaws; and a handle portion, wherein the handle portion comprising:

an outer shell disposed outside;

an extension body encircled by the outer shell, wherein a first end of the extension body extends into interior of the outer shell, a second end of the extension body is connected to the jaws, and the outer shell and the extension body are not rotatable relative to each other, a locking element encircling the extension body, wherein the locking element is also connected to the outer shell, and the extension body is not rotatable relative to the locking element, wherein the extension body is extendable out of the outer shell but not retractable back to the outer shell when the locking element is in a locked position, and the extension body is extendable out of the outer shell and retractable back to the outer shell when the locking element is in an unlock position, wherein the locking element is a locking plate having a loop portion configured to encircle the extension body and a plate portion configured to fixedly attach to the outer shell, wherein the locking plate is in the locked position when the loop portion of the locking plate is tilted relative to the extension body, and the locking plate is in the unlock position when the loop portion of the locking plate is perpendicular or substantially perpendicular to the extension body, a push button disposed on the outer shell, wherein the push button is configured to unlock the locking plate, the push button is coupled to an outer side surface of the outer shell through a first spring element, a first end of the push button is connected to the plate portion of the locking plate, a second end of the push button is pushable, the plate portion of the locking plate is moved to be perpendicular to or substantially perpendicular to the extension body by pushing the second end of the push button, wherein the outer shell comprises a protruding portion extending from one side, the protruding portion has a through hole, and the plate portion of the locking plate is threaded through the through hole to connect with the first end of the push button.

9. The pipe wrench of claim 8, wherein the first end of the push button has a slot, the plate portion of the locking plate is inserted into the slot and secured to the slot to prevent the locking plate from falling out of the slot.

10. A pipe wrench comprising:

jaws; and a handle portion comprising:

an outer shell;

an extension body, wherein a first end of the extension body extends into an interior of the outer shell, a retaining hole is formed in the extension body from the first end of the extension body, and a second end of the extension body is connected to the jaws;

a spring element disposed between the outer shell and the extension body, wherein a first end of the spring element is disposed in the retaining hole of the extension body, and a second end of the spring element extends out of the extension body and is secured to the outer shell; and a locking element connected to the outer shell and operable between a locked position and an unlock position, wherein the extension body is not retractable back to the outer shell when the locking element is in the locked position, and the extension body is extendable out of the outer shell when the locking element is in the unlock position, and the locking element comprises:

a locking plate having a loop portion encircling the extension body and a plate portion extending from the loop portion; and a push button disposed on the outer shell, wherein the push button is connected to the plate portion of the locking plate and configured to move the locking plate between a locked position and an unlock position, wherein the outer shell comprises a protruding portion extending from one side, the protruding portion has a through hole, and-the plate portion of the locking plate is threaded through the through hole to connect with the push button.

11. The pipe wrench of claim 10, wherein the spring element is a tension spring.

12. The pipe wrench of claim 10, further comprising an energy saving handle disposed through the outer shell at a distal end from the jaws, wherein the second end of the spring element is attached to the energy saving handle.

13. The pipe wrench of claim 10, wherein the loop portion of the locking plate is tilted relative to the extension body when the locking plate is in the locked position, and the loop portion of the locking plate is perpendicular or substantially perpendicular to the extension body when the locking plate is in the unlock position.

14. The pipe wrench of claim 10, wherein the push button is connected to the outer shell by a compression spring.

15. The pipe wrench of claim 10, wherein the push button has a slot, the plate portion of the locking plate is inserted into the slot and secured to the slot.

* * * * *